United States Patent [19]

Paterson et al.

[11] 4,082,228

[45] Apr. 4, 1978

[54] AUTOMATIC BYPASS APPARATUS

[75] Inventors: Malcolm M. Paterson, Lee, N.H.; Ernest N. Yelle, Methuen, Mass.

[73] Assignee: Raytheon Company, Lexington, Mass.

[21] Appl. No.: 771,051

[22] Filed: Feb. 22, 1977

[51] Int. Cl.[2] ..... B02C 23/02

[52] U.S. Cl. ..... 241/34; 241/135; 214/17 CA; 193/39

[58] Field of Search ..... 241/32, 33, 34, 35, 241/79.1, 101 D, 101.3, 101.5, 135, 186.2, 186.3; 214/17 CA; 193/31 R, 31 A, 39

[56] References Cited

U.S. PATENT DOCUMENTS

| | | | |
|---|---|---|---|
| 2,336,434 | 12/1943 | Wurzbach | 241/35 |
| 2,440,388 | 4/1948 | Wright | 241/135 |
| 2,652,984 | 9/1953 | Dodds | 241/135 |
| 2,865,484 | 12/1958 | Biddison | 193/39 |
| 3,082,963 | 3/1963 | Gondard | 241/186.2 |
| 3,734,414 | 5/1973 | Weigel et al. | 241/135 |
| 3,770,217 | 11/1973 | Maier et al. | 241/135 |

*Primary Examiner*—Granville Y. Custer, Jr.
*Attorney, Agent, or Firm*—Harold A. Murphy; Joseph D. Pannone; John T. Meaney

[57] ABSTRACT

A waste materials handling system which includes materials transporting apparatus for conveying materials being processed to a processing device such as a shredder which is subject to unexpected and relatively sudden discontinuance of operation as by clogging or other breakdown condition, the invention comprising means for detecting such breakdown and for consequently diverting flow of materials away from the apparatus without interrupting the flow of materials through the system.

15 Claims, 14 Drawing Figures

AUTOMATIC BYPASS APPARATUS

BACKGROUND OF THE INVENTION

Material handling systems have been commonly employed for receiving a continuous flow of materials of various types, sizes, and consistencies and for performing various processing techniques upon these materials as they are transported from one station to another. For example, municipal waste handling systems are adapted to receive a continuously flowing supply of commingled waste materials, transport the materials to a device such as a shredder where the materials are reduced to a maximum preselected size, and then transport the shredded materials to a collection area for storage or subsequent processing such as classification, incineration, or the like.

It is well known that municipal waste, for example, contains a wide variety of miscellaneous components such as garbage, paper, aluminum and tin cans, plastic items, textiles, and large steel and iron items such as castings, for example. It is necessary that large items be considerably reduced in size where the commingled materials are to be further processed, such as where subsequent classification is to be performed. For such size reduction it is required that the received commingled materials be moved through a suitable shredder which employs a system of knives, hammers, or grinding elements to reduce the overall size of the materials to a selected maximum, such as twelve inches, one inch, or other selected dimension.

Shredders of conventional construction, however, as a result of such heavy duty use are often subject to unexpected or relatively sudden discontinuance of operation or breakdown such as might be caused, for example, by jamming or clogging, or by damage to the size-reducing knife or hammer elements, or for other reasons. In such cases it has been necessary to shut down the operation of the entire system or of a substantial portion thereof, while the damage to the shredder is being repaired or while any other reason for the breakdown is being rectified. Obviously, such shutting down of a system of this character is highly undesirable for many reasons. For example, a system of this type is designed to process a selected relatively large number of tons of material during each hour of operation. Shutting down is consequently expensive in not only loss of processed materials value, but also in undesired reduction in operating manpower.

SUMMARY OF THE INVENTION

The foregoing and other objections to and disadvantages of known material handling or processing systems are overcome in the present invention which includes a shredder or other processing device, conveyor means for transporting mixed materials to the device, and means connected to the device and operable upon detection of breakdown of the device to automatically divert the materials away from the device without interrupting the flow of the materials through the system.

More specifically, a feed chute or the like between the conveyor means and the device is moved so as to divert the materials to a second conveying means which will continue the flow of the materials without interruption by bypassing the processing device. Preferably the chute is a movable member which, when moved to cause diverting of the material flow, also closes the feed entrance to the device.

In one embodiment of the invention, the diverted material flows into a separate hopper from which it is moved pneumatically to the next-in-line processing device. In other embodiments the flow is diverted to an auxiliary conveyor which removes the materials to any selected storage or processing area.

Detection of breakdown of the processing device may be accomplished in a suitable manner. For example, in a shredder the knives or hammers are actuated by an electrical motor which is connected to a source of electrical power through a thermal overload which opens when the motor becomes stopped or overly strained. This will simultaneously cause operation of solenoids or reversible motors which automatically move the chute to divert the flow of material as mentioned above.

BRIEF DESCRIPTION OF THE DRAWINGS

The above and other advantages of the invention will become apparent from the following description taken in connection with the accompanying drawings, wherein.

DESCRIPTION OF THE PREFERRED EMBODIMENT

Figure 1:
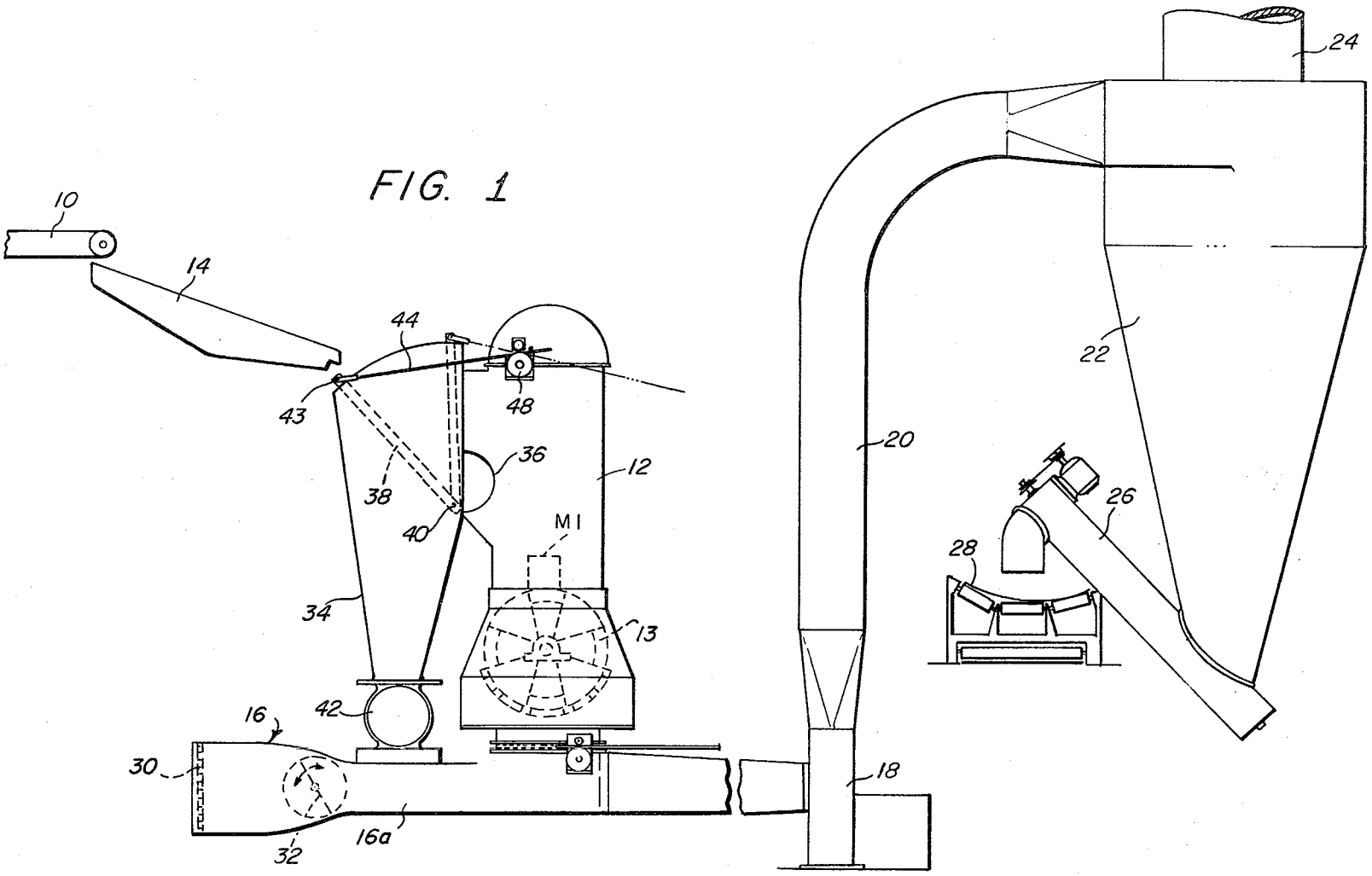
FIG. 1 is an elevational view of a portion of a materials handling system embodying one form of the invention.
Figure 2:
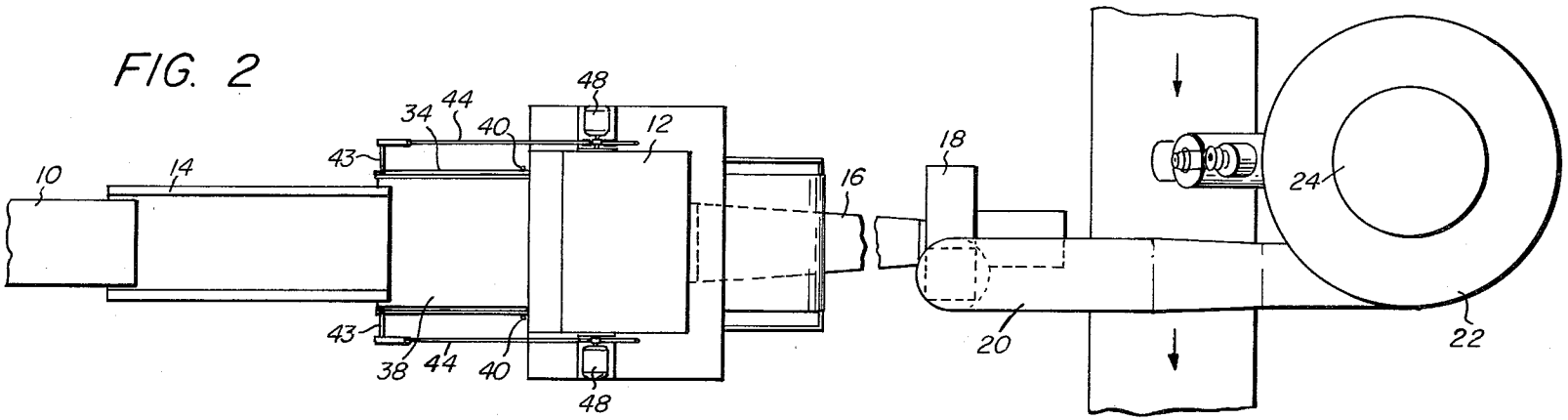
FIG. 2 is a plan view of the system shown in FIG. 1.

Referring more particularly to the drawings, FIGS. 1–6 illustrating one embodiment of the invention, with FIGS. 1 and 2 showing a portion of a materials handling system and FIGS. 3–6 showing a processing device specifically illustrated as a shredder having one form of the invention combined with it.

Briefly, the system of FIGS. 1 and 2 includes a conveyor 10, which may be a belt, screw or other type, provided for receiving and transporting materials to be processed from a conventional source or supply to the vicinity of a processing device such as shredder 12. The materials being processed by the described equipment are preferably preshredded. Municipal waste, for example, which normally consists of materials of various consistencies such as garbage, paper, plastics, metal cans, bottles, and cast iron or steel objects are preferably preshredded to a size of less than 1 cubic foot so that they may be efficiently air classified. The lighter objects which, when classified, become air-borne, such as paper, thin plastics, light pieces of cloth, leaves, and the like; are subsequently deposited on the conveyor 10. Then, for effective subsequent classification, these objects are desirably again shredded, this time to a size of less than 1 cubic inch, for example. Shredder 12 is intended to perform such additional shredding.

It has been found that the materials to be deposited in shredder 12 often contain low mesh glass or ceramic fractions. Therefore, before proceeding into the shredder 12, the materials pass from conveyor 10 onto a suitable screen 14 which, if desired, may be of a vibratory type so that such glass or ceramic fractions may be removed through the screen while the remaining larger items will continue on into the shredder 12.

Within the shredder are the usual size-reducing elements 13, such as hammers having blades thereon (not shown), for example, which are movable in a conventional manner by means of a motor M1. Shredded materials then drop to the bottom of the shredder 12 and pass out through an opening therein into an accelerator tee injector 16 in the form of a horizontally disposed conduit having a portion 16*a* of reduced diameter immediately beneath and connected with the shredder 12, the conduit being connected to a materials handling blower 18 at one end. The blower functions to suction shredded materials from the bottom of the shredder into injector 16 and to direct them through suitable ducts 20 to a cyclone 22. Cyclone 22 may be any convenient collector which functions to separate the materials from the air stream created by the blower 18. In such a device, the materials will drop down into the conical bottom portion of the cyclone for storage and the separated air stream will pass upwardly out of the cyclone through a duct 24 to a suitable dust collector (not shown) and thence to the atmosphere as clean air. Stored materials may be subsequently removed from the cyclone by means of a screw conveyor device 26 which will deposit the materials on a suitable conveyor 28 for removal to suitable additional processing equipment or for other purposes. Regulation of air flow through the injector may be suitably controlled by a louvered end portion 30 in the injector conduit 16 and by a balancing damper 32, in a conventional manner.

It is well known that processing devices such as shredders often become damaged or inoperable or must be renewed. In such cases it is usually necessary to shut down the entire system so that such damage may be repaired. This sometimes results in lengthy shutdowns with consequent reduction in output of the system and in inefficient utilization of manpower.

In accordance with the present invention there is provided means for detecting breakdown of the shredder and means operating in response to such detection of breakdown for diverting the flow of materials in bypassing relation to the shredder. This will obviously overcome the problems caused by stoppage of the system when the shredder breaks down, although the materials will not always be subjected to the desired subsequent shredding process unless such diversion of the flow of materials causes the materials to be directed to an auxiliary or standby shredder before they pass to the cyclone.

As shown in FIGS. 1–6, the invention comprises a hopper 34 which is interposed between the shredder 12 and the adjacent discharge end of screen 14. The hopper may be of any convenient shape having an open upper end into which materials from screen 14 are dropped. The shredder is provided with the usual horizontally extending feed or entrance opening 36 through which the materials are deposited into the interior of the shredder. The hopper 34 is provided with a portion of its side wall nearest the shredder opening 36 removed. Adjacent the shredder and within the hopper 34 is disposed an angled feed chute 38 which is disposed with its upper end adjacent and beneath the discharge end of screen 14 and its lower end positioned adjacent opening 36 so that materials from the screen 14 will slide down chute 38 through opening 36 into the shredder. The chute is pivotally connected by pins 40 to the inner side walls of the hopper 34. This is the normal operational position of the parts of the invention when the shredder is in operation.

When the shredder becomes jammed or otherwise inoperable, means is provided for detecting such condition and, in response thereto, for automatically moving the chute 38 in a clockwise direction about the pivotal points 40 at its lower end, into closing relation to the opening 36 in the shredder 12. This will cause the materials from the screen 14 to fall directly downwardly within the hopper to the lower end thereof without passing into the shredder. The materials will then be transported from the bottom portion of the hopper 34 through an air lock 42 of convenient type into the injector 16, whereupon the blower will then cause such materials to become entrained within the air stream and directed into the cyclone without passing through the shredder 12.

Figure 4:
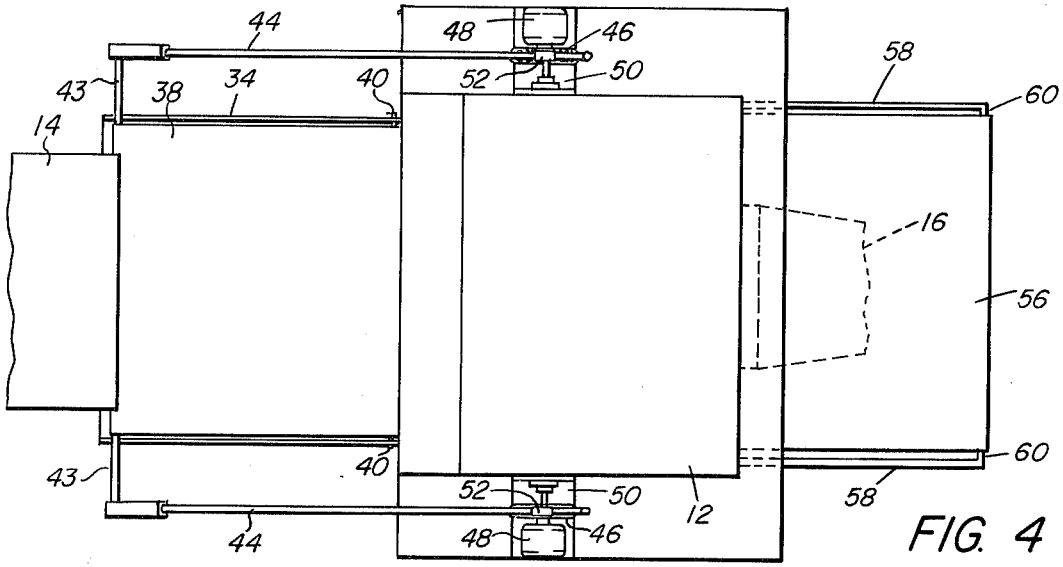
FIG. 4 is a plan view of the apparatus shown in FIG. 3.
Figure 3:
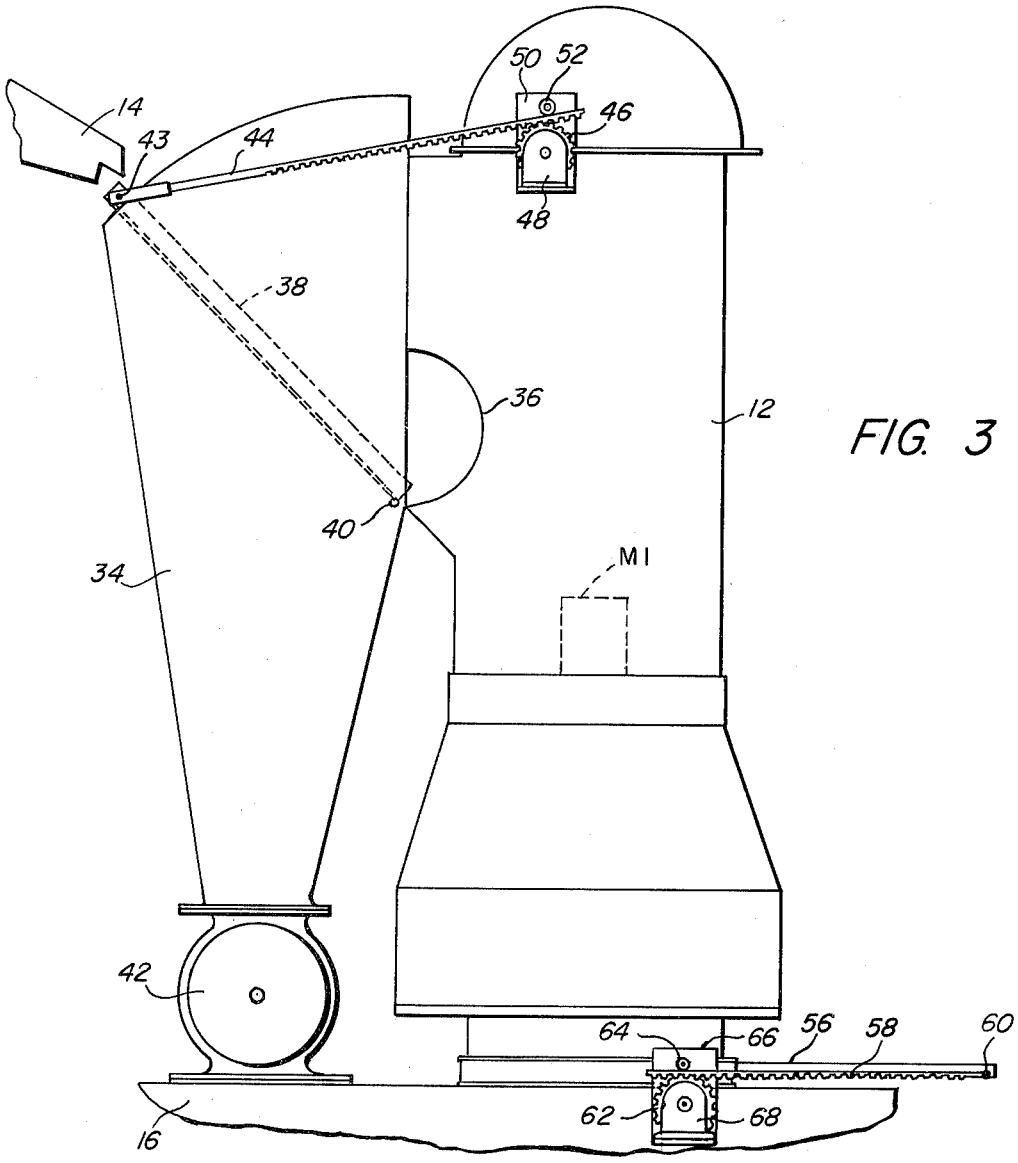
FIG. 3 is an enlarged elevational view showing a shredder having the invention associated therewith in normal operating condition.
Figure 6:
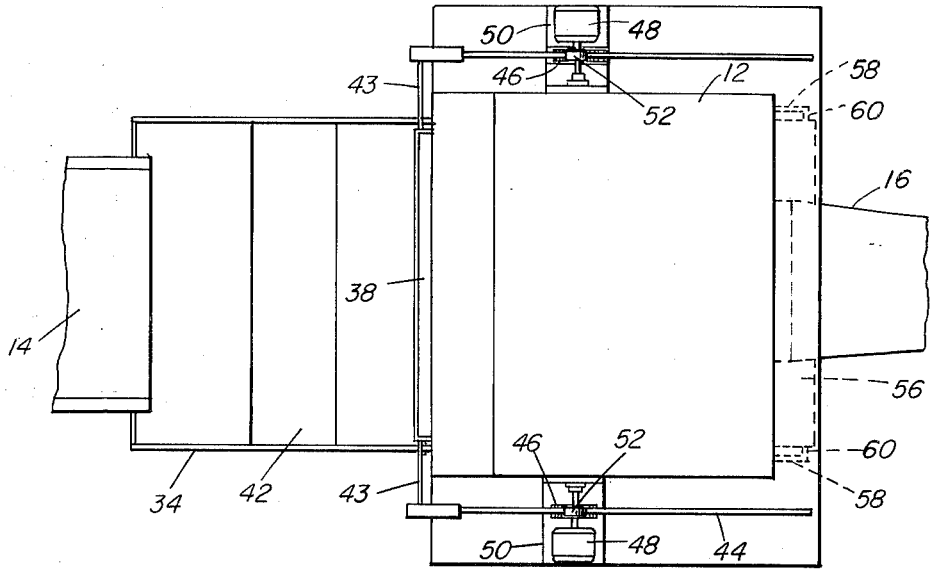
FIG. 6 is a plan view of the apparatus shown in FIG. 5.
Figure 5:
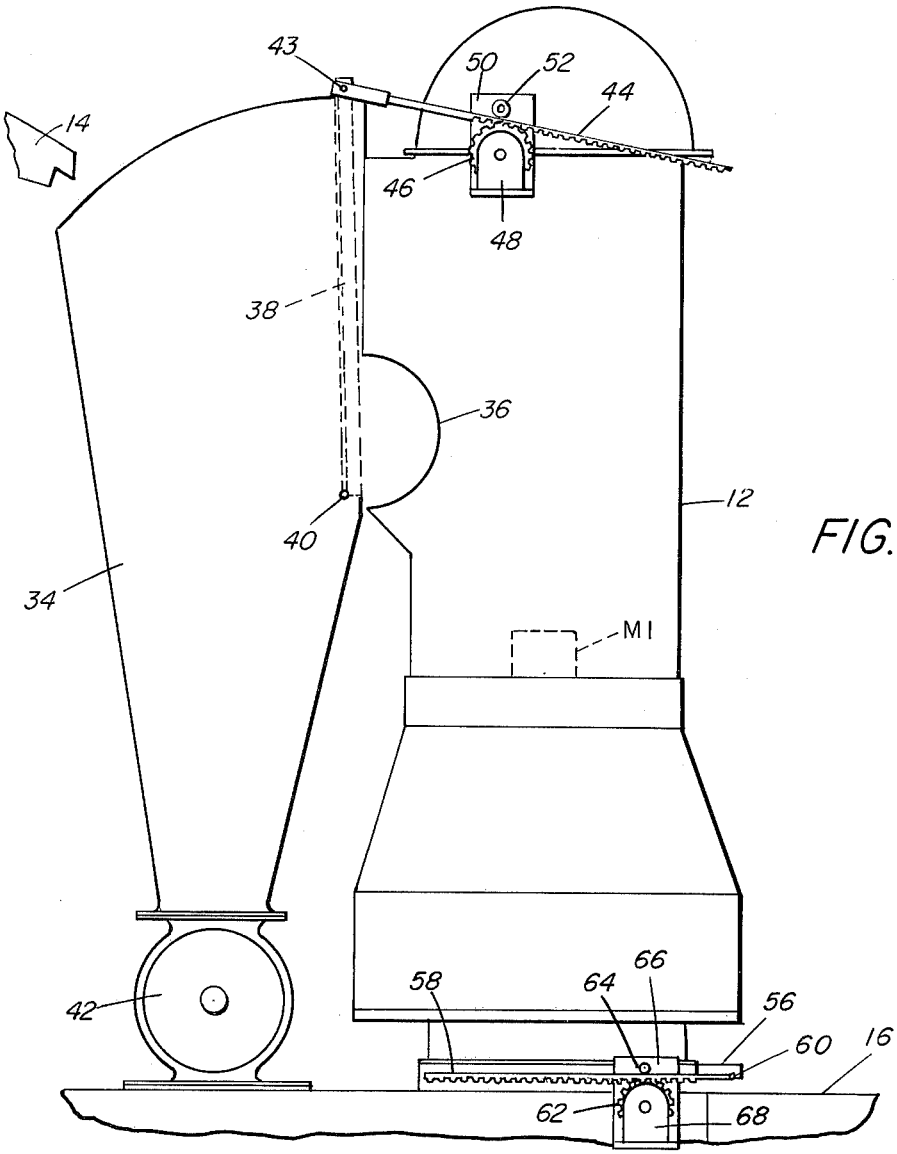
FIG. 5 is a view similar to FIG. 3 showing the invention under breakdown conditions of the shredder.

The feed chute 38 is of a length to extend slightly above the upper end of the hopper and carries a pair of rods 43 which extend transversely from opposite sides thereof. A pair of elongated rack bars 44 are disposed one opposite each side wall of the hopper, and have one end connected to a respective rod 43. FIGS. 3 and 4 illustrate the parts of the device in the positions they occupy when the shredder 12 is being operated in the normal manner. It will be noticed that the upper end of the chute 38 will normally be disposed beneath the adjacent end portion of screen 14 so that it will not interfere with the flow of materials from the screen.

The opposite end portions of the racks 44 are intermeshed with gears 46 which are rotatably carried by suitable shafts which extend from respective motors 48. Motors 48 are supported by suitable brackets 50 carried by the side walls of the shredder 12, and rollers 52, carried by the brackets 50, engage the opposite sides of the racks 44 to retain the teeth of the racks in constant meshed engagement with the teeth of the gears 46. Thus, upon operation of motors 48, consequent rotation of the gears 46 will move the rack arms 44 to the positions shown in FIGS. 5 and 6. Such movement of the racks 44 will create a pulling action upon the chute 38, causing it to move about the pivots 40 to the position shown in FIGS. 5 and 6.

The shredder motor M1 may be employed as the element which performs detection of the breakdown of the shredder. A heat overload switch 54 (FIG. 7) is connected between motor M1 and the source of energy SE. Motors 48 are also connected to the source of energy SE but are deactivated when the switch 54 is closed to energize motor M1. However, when the motor M1 becomes overloaded, the resultant heat thereof will be detected by switch 54 which will operate to open the circuit to motor M1 and to close the circuits to motors 48 and then to trip off. This will cause motors 48 to quickly move the feed chute 38 to the position shown in FIGS. 5 and 6. When the shredder is subsequently made operable, the switch 54 will be returned to a position which will energize motor M1 and which will also energize motors 48 to cause them to operate in a reverse direction for the necessary time to return the feed chute 38 to the position shown in FIGS. 3 and 4 and then shut off, whereupon the flow of materials from the screen 14 will be diverted back into the shredder.

In some instances it may be desirable, when diverting flow of materials away from the shredder 12, to also close off the flow of at least some of the air which is drawn from the shredder into the injector 16, thus possibly increasing air flow from the hopper 34 to the injector 16. Mechanism for accomplishing this is shown in FIGS. 3–6 and comprises a plate 56 which is mounted in suitable slideways (not shown) to slide into and out of blocking relation to the opening at the bottom of the shredder 12. In FIGS. 3 and 4, the plate 56 is shown in its normal retracted position.

Figure 7:
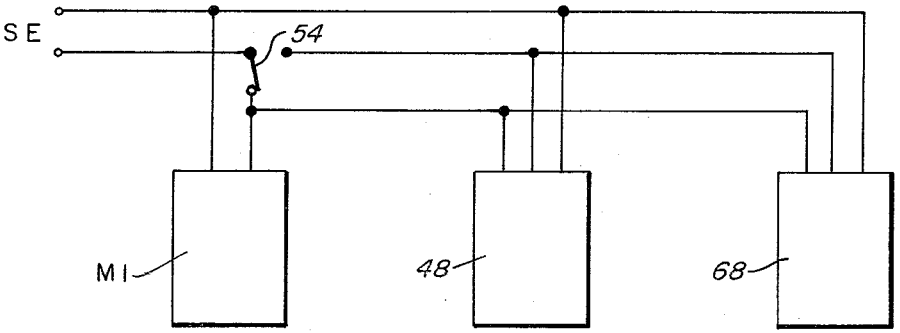
FIG. 7 is a schematic diagram of a circuit usable with the invention.

On each side of the plate is a rack bar 58 which is attached at one end to the adjacent edges of the plate near its outer end by pins 60. The rack bars 58 are each held in meshed engagement with a gear 62 by a roller 64 which is carried by a bracket 66 mounted on the side of injector conduit 16. Brackets 66 also support a reversible motor 68 on the operating shaft of which the gear 62 is fixed. As shown in FIG. 7, motor 68 is operatively connected into the electrical circuit in parallel with reversible motor 48 so that when thermal switch 54 opens the circuit will be closed to motor 68 causing it to operate in a direction which will rotate the gear 62 and move the rack bar 58 to the position shown in FIGS. 5 and 6. This will cause the plate 56 to be pulled in closed position with respect to the exit opening in the shredder, reducing the flow of air from the shredder 12 to the conduit 16. When the thermal switch 54 is subsequently returned to normal position, the motor 68 will be operated in the reverse direction to move the plate 56 outwardly, thus enabling air and shredded materials to pass from the shredder into the conduit.

Figure 8:
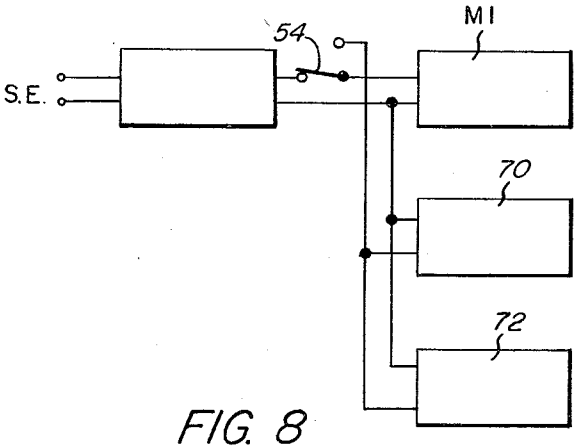
FIG. 8 is a schematic diagram of another circuit usable with the invention.

It is particularly pointed out that, although reversible motors 48 and 68 have been disclosed as operative devices for moving the chute 38 and plate 56, other means such as solenoids may be used for this purpose. FIG. 8 illustrates a circuit which may be used with solenoids 70 and 72 replacing motors 48 and 68 respectively. When motor M1 becomes inoperative, thermal switch 54 will flip to shut off current to the motor. At the same time, switch 54 will close circuits to the solenoids 70 and 72 which, being operatively connected to the rack bars 44 and 58 respectively, will move the bars and consequently the chute 38 and plate 58 to their "diverting" or secondary positions. Upon return of the switch 54 to normal position, the motor M1 will be reactivated and solenoids 70 and 72 will be de-energized and will automatically return the rack bars, chute and plate to their normal positions.

Figure 10:
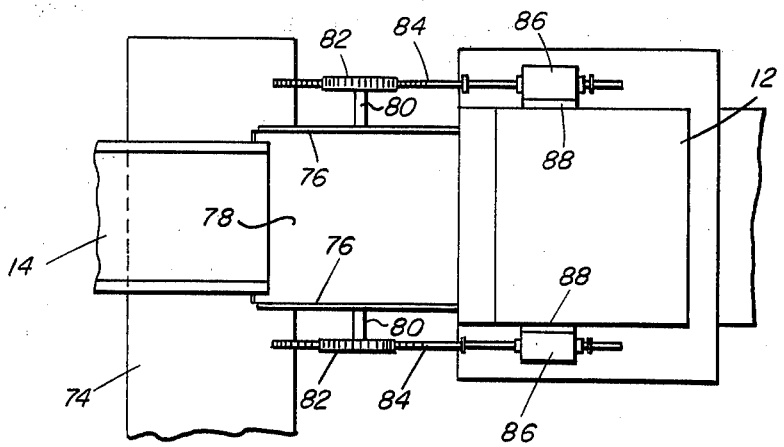
FIG. 10 is a plan view of the apparatus shown in FIG. 9.
Figure 9:
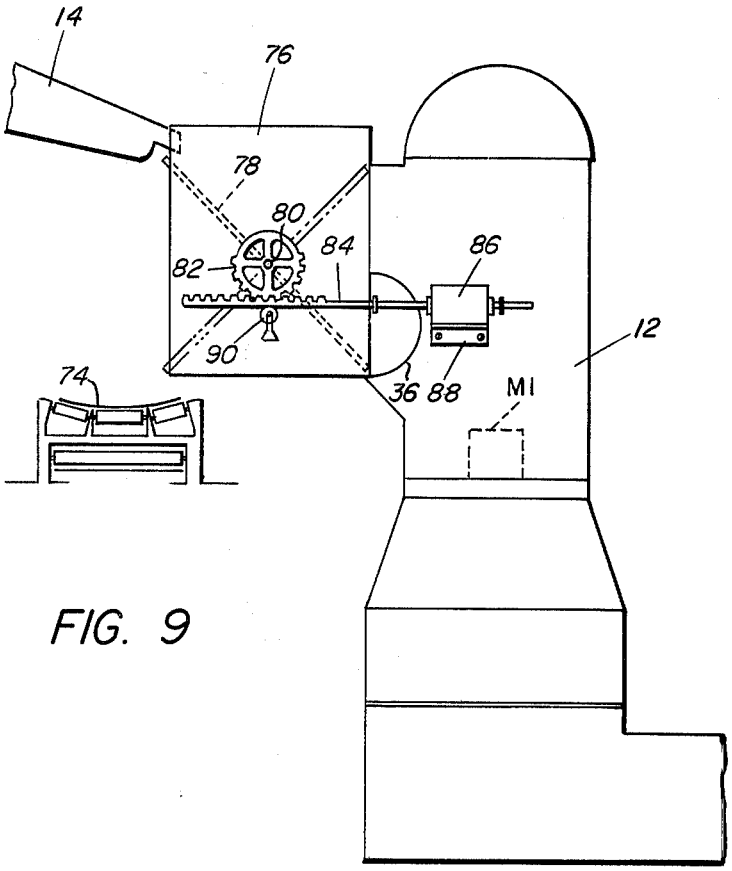
FIG. 9 is an enlarged elevational view showing a shredder having a modified form of the invention.

Referring now particularly to FIGS. 9 and 10, in this embodiment of the invention materials flow is diverted, when the shredder 12 is inoperative, to a conveyor 74. Between the screen 14 and the shredder 12 are a pair of spaced, parallel, vertically extending guide plates or spillage guards 76 which are suitably mounted as by securing at one edge to the shredder 12 at opposite ends of the shredder feed opening 36. Between the plates 76 is a feed chute 78 which is normally positioned to guide the flow of materials from the screen 14 into the shredder feed opening 36, as shown in FIG. 10 and as indicated by dotted lines in FIG. 9.

The chute 78 is supported by shafts 80 which are secured at one end to opposite sides of the chute. Shafts 80 are suitably journaled in the respective guards 76 and extend outwardly therefrom. On the outer end of each shaft 80 is fixed a gear wheel 82 which is meshed with the teeth on a rack bar 84. Bars 84 are operatively connected with solenoids 86 mounted by suitable brackets 88 on the side walls of the shredder 12. Retaining means such as rollers 90 (FIG. 9) supported on guards 76 serve to maintain the rack bars 84 constantly in meshed relation to the gear wheels 82.

The solenoids 86 are electrically connected to the shredder motor M1 similar to the solenoids 70 shown in FIG. 8 so that when the motor becomes inoperative the thermal switch operates to de-energize the motor M1 and energize the solenoids 86. This will cause the rack bars 84 to move, consequently rotating gear wheels 82 and shafts 80, and turning the chute 78 to the position shown by dot-dash lines in FIG. 9. When the chute 78 is in this position, it blocks the entrance 36 to the shredder and diverts flow of materials from the screen 14 onto the conveyor 74.

When the shredder breakdown or other cause of suspension of operation of the shredder is rectified, the thermal switch 54 is returned to its normal position, energizing the motor M1 and de-energizing the solenoids 86 which cause the chute 78 to be returned to its initial position where materials will again be fed into the shredder 12 instead of onto the conveyor 74.

Figure 12:
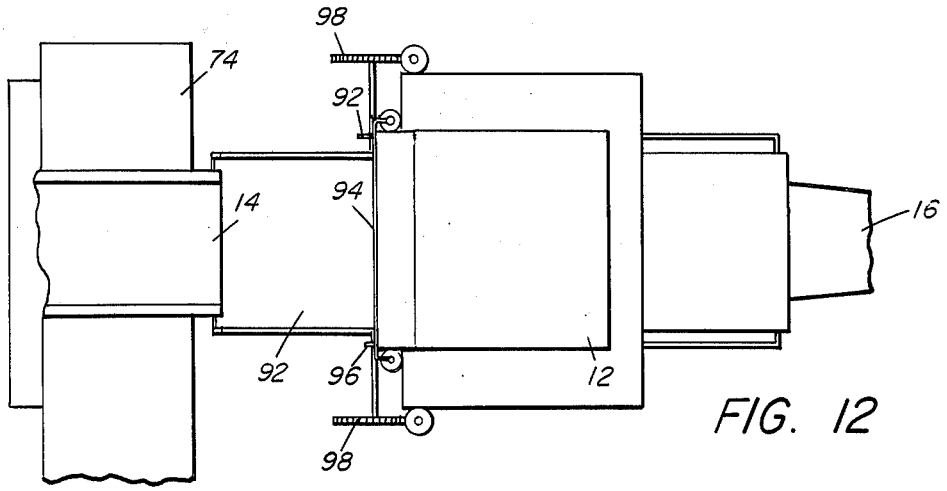
FIG. 12 is a plan view of the apparatus shown in FIG. 11.
Figure 11:
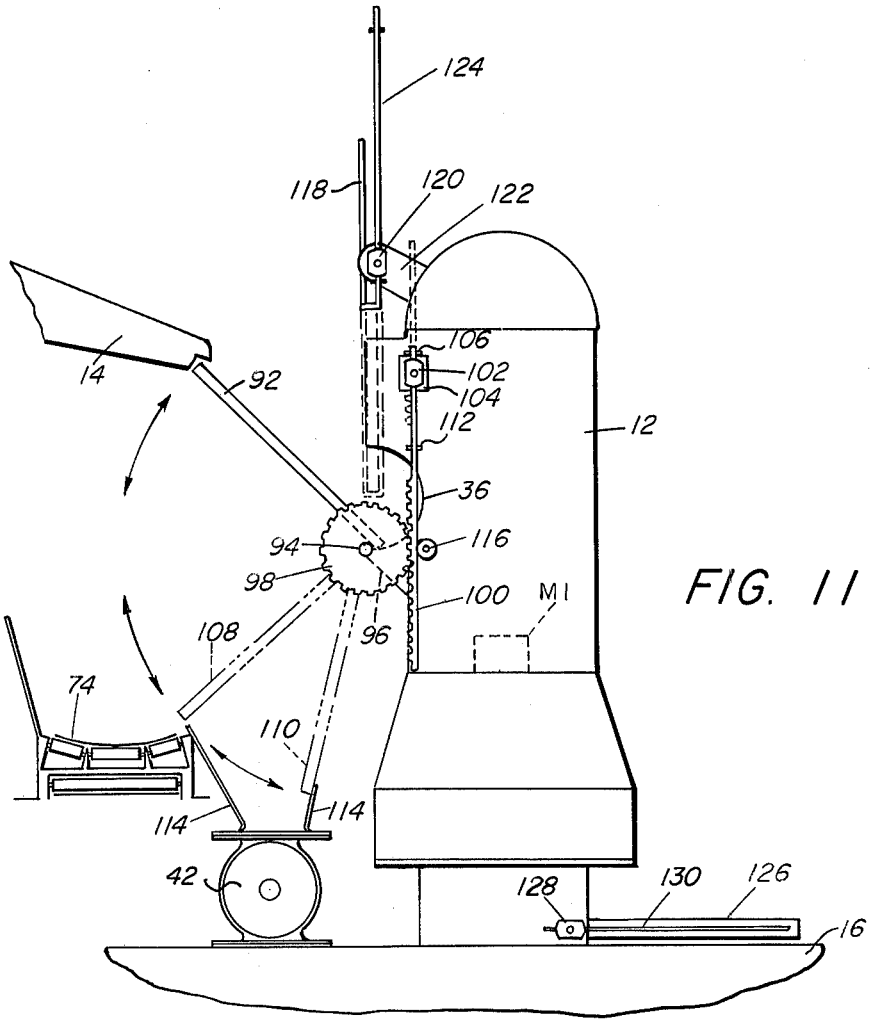
FIG. 11 is an enlarged elevational view of a shredder having a still further form of the invention.

In the embodiment of the invention shown in FIGS. 11 and 12, the bypass mechanism is operable, upon detection of breakdown, to selectively divert the flow of materials from the screen 14 to either a mechanical removal system such as conveyor 74 or to a pneumatic removal system such as the air injector 16. The chute 92 is normally positioned with its lower end adjacent the feed opening 36 of the shredder 12 so that materials will flow into the shredder and from the shredder into the air injector conduit 16.

The chute 92 is pivotally mounted at its lower end on a rotatable shaft 94 which is supported as by spaced brackets 96 or the like on the shredder. On the outer ends of the shaft 94 are located gear wheels 98 which, when rotated, cause consequent rotation of the shaft 94 and chute 92. Means for accomplishing such rotation comprises a pair of vertically disposed rack bars 100, one on each side of the shredder, which bars are located within solenoids 102 for vertical longitudinal movement. The solenoids 102 are suitably supported such as by brackets 104 fixed to the sides of the shredder. As shown by solid lines in FIG. 11, the rack bar 100 is normally disposed at its lowermost position as controlled by a stop 106.

The solenoids 102 are connected into an electrical circuit similarly to solenoid 70 in FIG. 8 so that when shredder motor M1 is inoperative the thermal switch 54 will energize the solenoids and simultaneously de-energize the motor. Energization of the solenoids 102 will cause rack bars 100 to be pulled upwardly, thus rotating gear wheels 98 and shaft 94 and consequently moving the chute downwardly to one of the two positions 108 or 110 shown by dot-dash lines in FIG. 11. Adjustable stops 112 on the rack bars 100 beneath the solenoids 102 are adapted to be positioned to limit the extent of upward movement of the rack bars, thereby determining which bypass position the chute 92 is to be located.

In the first bypass position 108 the chute 92 will direct materials from the screen 14 onto a mechanical removal device such as conveyor 74. In the second bypass position 110 the chute will direct materials from the screen 14 between spillage guards 114 and into the rotary air lock 42 from which they are drawn pneumatically into the air conduit 16. Rollers 116 on the sides of the shredder engage the back sides of the rack bars 100 to retain the bars constantly in mesh with the gear wheels 98.

A shut-off plate 118 is vertically mounted above the feed opening 36 of the shredder and is adapted to be dropped into closing relation to opening 36 simultaneous with movement of the chute 92 into a bypass position. This is accomplished by a second pair of solenoids 120 which are mounted as by brackets 122 on the top portion of the shredder 12 and a pair of vertically extending rods 124, one associated with each solenoid 120. The lower ends of the solenoid-operated rods 124 are fixedly connected to respective sides of the plate 118. The solenoids are connected into the electrical circuit similarly to solenoids 72 in FIG. 8. Thus, when the motor M1 is inoperative, thermal switch 54 will energize the solenoids 120, causing them to pull the rods 124, and consequently the plate 118, downwardly into overlying relation to the feed opening 36. This is done simultaneously with lowering of the chute 92.

Furthermore, a slidable shutoff plate 126 at the bottom of the shredder 12 also may be simultaneously operated to close the outlet opening in the shredder upon activation of a pair of solenoids 128 and operating rods 130 connected to the plate 126, as set forth in the description of the embodiments of FIGS. 1–6.

When the shredder 12 is subsequently again operable, thermal switch 54 will be returned to a position where motor M1 is reenergized and solenoids 102, 120, and 128 are deenergized. This will cause the parts of the device to be returned to their normal positions as shown in full lines in FIG. 11.

This embodiment of the invention is particularly suitable also in cases where it is desirable to divert the material for other reasons than inoperation of the shredder such as, for example, when the particular characteristics of the materials being processed are not conducive to shredding and, therefore, are to be bypassed to other processing equipment.

Figure 14:
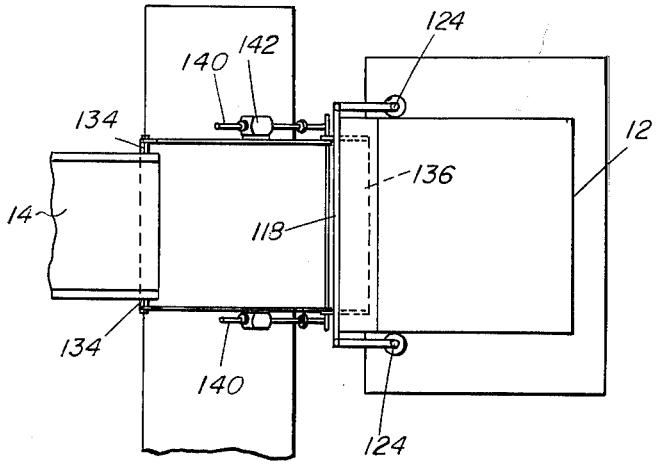
FIG. 14 is a plan view of the apparatus shown in FIG. 13.
Figure 13:
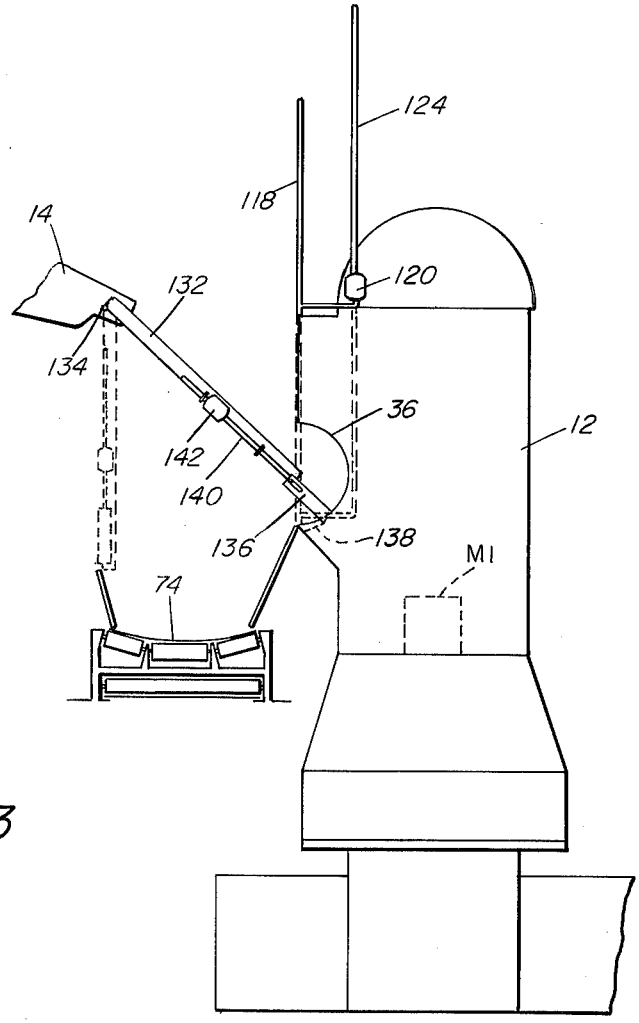
FIG. 13 is an elevational view of an additional embodiment of the invention.

In a still further embodiment of the invention, as depicted in FIGS. 13 and 14, a chute 132 is pivotably attached at one end as by pins 134 to the screen 14 and normally extends toward the feed opening 36 in the shredder 12. A slidable extension 136 on the lower end of the chute 132 is disposed within the opening 36 and rests upon the lower edge of the opening, preferably upon a lip 138 formed thereon.

The extension 136 is retractable by means of a pair of rods 140 extending along each side of the chute and actuated by solenoids 142, the lower ends of the rods 140 being attached to the extension 136 so that when the solenoids 142 are operated the rods and extension will retract. This will remove the extension from the lip 138 and allow the chute 132 to drop down to the position shown by dotted lines in FIG. 13. With the chute in this position, the materials from the screen 14 will drop down onto the conveyor 74, thus bypassing the shredder 12.

At the same time a shut-off plate 118 will drop down into closing relation to the feed opening 36 upon operation of solenoids 120 and consequent downward release of rods 124 which are connected to and support the plate 118, similar to the arrangement disclosed in FIG. 11.

The solenoids 142 and 120 are electrically connected to respond to inoperation of the shredder motor M1 as shown in FIG. 8 so that the shredder will be immediately and effeciently bypassed when the shredder is determined to be inoperative.

It will be apparent from the foregoing that all of the objectives of this invention have been accomplished by the bypassing apparatuses shown and described whereby an unexpected inoperativeness of a device in system will be detected and flow of materials will be allowed to proceed in bypassing relation to the device without interruption.

It will also be apparent that modifications and changes in the structures shown and described may be made by those skilled in the art without departing from the spirit of the invention as expressed in the accompanying claims. Therefore, all matter shown and described is to be interpreted as illustrative and not in a limiting sense.

What is claimed is:

1. A material handling system comprising first material transporting means for moving material from a first location to a second location, a processing device at said second location for receiving said material and including means operable to process material therein, diverting means for detecting inoperation of said processing means and operative in response thereto to automatically divert flow of said material away from said processing device without interrupting the flow of the material from the first transporting means, second material transporting means for receiving material from said processing device and moving it to a third location, and third material transporting means adjacent said processing device, said diverting means including means for directing flow of said material from the first transporting means selectively to said second or third transporting means in bypass relation to said processing device.

2. A material handling system comprising conveying means for moving material from a first location to a second location, a shredder at said second location for receiving said material and including mechanism for shredding material therein, a hopper disposed at said second location adjacent the shredder, a chute between said conveying means and shredder and located normally in a first position to guide material from the conveying means into the shredder, diverting means connected with said chute and said mechanism and operable when said mechanism is inoperative to move the chute to a second position to divert flow of material away from the shredder into the hopper without interrupting the flow of material from the conveying means, said shredder being provided with an outlet opening, and a closure member disposed in normally open relation with said outlet opening and mounted for movement into closing relation to the outlet opening simultaneously with operation of said diverting means when said mechanism is inoperative.

3. A material handling system comprising first conveying means for moving material from a first location to a second location, a shredder at said second location for receiving said material and including mechanism for shredding material therein, pneumatic conveying means at the outlet end of the shredder having a first material-receiving portion for receiving shredded material from the shredder and moving it to a third location, said pneumatic conveying means having a second material-receiving portion adjacent the shredder, second conveying means adjacent said second material-receiving portion, a chute between said first conveying means and shredder and located normally in a first position to guide material from the first conveying means to the shredder, and diverting means connected with said chute and said mechanism and operable when said mechanism is inoperative to move the chute to a second position to divert flow of material away from the shredder selectively to said second material-receiving portion or to said second conveying means without interrupting flow of material from the first conveying means.

4. A system as set forth in claim 3 wherein said chute is normally inclined with its upper end disposed adjacent the discharge end of the first conveying means and its lower end adjacent the feed opening of the shredder, the chute being supported adjacent its lower end for pivotal movement into and out of said second position upon operation of said diverting means.

5. A system as set forth in claim 4 wherein said mechanism includes a motor, and said diverting means includes electrical means connected with said chute and operable to move the chute to said second position, and detecting means connected with said motor and with said electrical means for detecting inoperation of said motor and for activating the electrical means to move the chute in response thereto.

6. A system as set forth in claim 5 wherein said electrical means is at least one motor operatively connected to the chute.

7. A system as set forth in claim 5 wherein said electrical means is at least one solenoid operatively connected to the chute.

8. A system as set forth in claim 5 wherein said detecting means is a thermal switch.

9. A system as set forth in claim 5 wherein said chute is pivotal on a shaft supported by the shredder, and rack and pinion mechanism is operatively connected between said shaft and electrical means for moving the chute.

10. A material handling system comprising first conveying means for moving material from one location to a second location, a shredder at said second location for receiving said material and including mechanism for shredding material therein, second conveying means at said second location adjacent the shredder, a chute between said first conveying means and shredder and located normally in a first position to guide material from the first conveying means into the shredder, and diverting means connected with said chute and said mechanism and operable when said mechanism is inoperative to move the chute to a second position to divert flow of material away from the shredder to said second conveying means without interrupting flow of material from the conveying means.

11. A system as set forth in claim 10 wherein said chute is inclined with its upper end disposed adjacent the first conveying means and its lower end normally positioned on the bottom of the feed opening into the shredder, the chute being pivotally supported at its upper end and having a retractable portion movable when said mechanism is inoperative to retract the lower end of the chute from the shredder and to allow the chute to drop to the second position to divert flow of material from the shredder to said second conveying means.

12. A system as set forth in claim 11 wherein said mechanism includes a motor, and said diverting means includes electrical means connected to said chute and operable to move said retractable portion, and detecting means connected with said motor and with said electrical means for detecting inoperation of said motor and for activating the electrical means to move the said retractable portion and chute in response thereto.

13. A system as set forth in claim 12 wherein said electrical means is at least one motor operatively connected to the chute.

14. A system as set forth in claim 12 wherein said electrical means is at least one solenoid operatively connected to the chute.

15. A system as set forth in claim 12 wherein said detecting means is a thermal switch.

* * * * *